United States Patent [19]

Franke

[11] 4,119,856

[45] Oct. 10, 1978

[54] X-RAY DIAGNOSTIC APPARATUS FOR PRODUCING SERIES EXPOSURES

[75] Inventor: Kurt Franke, Erlangen, Germany

[73] Assignee: Siemens Aktiengesellschaft, Berlin & Munich, Germany

[21] Appl. No.: 749,038

[22] Filed: Dec. 9, 1976

Related U.S. Application Data

[63] Continuation-in-part of Ser. No. 486,205, Jul. 5, 1974, abandoned.

[30] Foreign Application Priority Data

Sep. 7, 1973 [DE] Fed. Rep. of Germany ..... 2345317

[51] Int. Cl.[2] ..... H05G 1/30

[52] U.S. Cl. ..... 250/402; 250/409; 250/413

[58] Field of Search ..... 250/401, 402, 403, 404, 250/405, 413, 415, 408, 409

[56] References Cited

U.S. PATENT DOCUMENTS

| | | | |
|---|---|---|---|
| 3,356,847 | 12/1967 | Splain | 250/413 |
| 3,546,461 | 12/1970 | Craig | 250/416 R |
| 3,894,235 | 7/1975 | Franke | 250/402 |
| 3,902,069 | 8/1975 | Skarke | 250/413 |

*Primary Examiner*—Craig E. Church

*Attorney, Agent, or Firm*—Hill, Gross, Simpson, Van Santen, Steadman, Chiara & Simpson

[57] ABSTRACT

In conjunction with a known type of dose rate regulator adapted to reduce X-ray tube voltage when the exposure time set by the automatic exposure control drops below a lower time limit and to increase the voltage when the exposure time exceeds an upper time limit, manually operable switch means is provided having respective keys for selection of a preprogrammed shortest possible exposure time or a preprogrammed maximum exposure time and for simultaneously switching off the automatic exposure control and for actuating the dose rate regulator to form an automatic exposure means by transmitting thereto a reference value signal corresponding to optimum film darkening for the selected minimum or maximum exposure time.

6 Claims, 3 Drawing Figures

X-RAY DIAGNOSTIC APPARATUS FOR PRODUCING SERIES EXPOSURES

CROSS-REFERENCE TO RELATED APPLICATION

The present application is a continuation in part application based on my copending application U.S. Ser. No. 486,205 filed July 5, 1974 (now abandoned).

FIELD OF THE INVENTION

The present invention relates to an X-ray diagnostic apparatus for producing multiple or series exposures and, more particularly, moving-picture X-ray exposures.

In German Published Patent Application No. 1,929,894, an X-ray diagnostic apparatus of this type is described, in which the preparation of exposures is carried out by means of an illuminating screen. Inasmuch as the illuminating screen image possesses a constant degree of brightness due to control of the dose rate, it rarely occurs in actual practice that the limits of the exposure time can be reached. This case may, however, occur when the illuminating screen is omitted and the preparation of the exposures directly effected. In that instance, considerable simplification in the control of the X-ray diagnostic apparatus is achieved due to the automatic setting of the X-ray tube voltage. The exposure time is thereby always located between both limiting values. These two limiting values are, on the one hand, the shortest possible exposure time which is preset in view of the construction of the apparatus and the exposure arrangement - i.e. the film changer or the film camera - and, on the other hand, the shutter opening time. An X-ray diagnostic apparatus of this type is advantageously applicable to the field of angiocardiography, in which it is endeavored to extensively free the physician and his assistants from the need for technical manipulations. Consequently, in such an X-ray diagnostic apparatus there are obtained images wherein there is attained a suitable compromise between low movement-caused lack of definition and a good image contrast.

In some instances it is desirable to obtain images with the highest possible degree of contrast, or images with the lowest possible movement-caused lack of definition or unclarity. An X-ray diagnostic apparatus of the type described fails to possess the required applicability therefor.

SUMMARY OF THE INVENTION

Accordingly, it is an object of the present invention to provide an X-ray diagnostic apparatus of the above-mentioned type, wherein it is possible to manually influence the exposure time within the preset parameters and, thereby the image contrast and the movement-caused lack of definition.

The foregoing object is inventively attained by providing an X-ray diagnostic apparatus which is adapted for series exposures and, particularly, moving-picture exposures, including a manually-operable switch for selecting the exposure time for an exposure and for switching off an automatic exposure device, and capable of switching an X-ray dose rate regulator as well as the automatic exposure device so as to convey a reference value signal to the latter for the dose rate so as to formulate an optimum degree of film darkening for each selected exposure time.

In the inventive X-ray diagnostic apparatus it thus becomes possible when, for example, the lowest degree of movement-caused lack of definition is desired, to set the shortest possible exposure time for the individual exposures, preset by the X-ray diagnostic apparatus and the exposure arrangement. Furthermore, it is possible in order, for example, to obtain the best possible contrast, to select the shutter opening time of the film changer or the film camera as the exposure time. The X-ray voltage thereby is automatically adjusted within the context of the desired requirement. Within the scope of the invention, the shortest possible exposure time and the shutter opening time for the film changer or the film camera may be fixedly programmed into the switching means, so as to render possible a preprogrammed time selection.

BRIEF DESCRIPTION OF THE DRAWINGS

Further advantages and details of the invention may be now ascertained from the following description of an exemplary embodiment, taken in conjunction with the accompanying drawings; in which.

DETAIL DESCRIPTION

Figure 1:
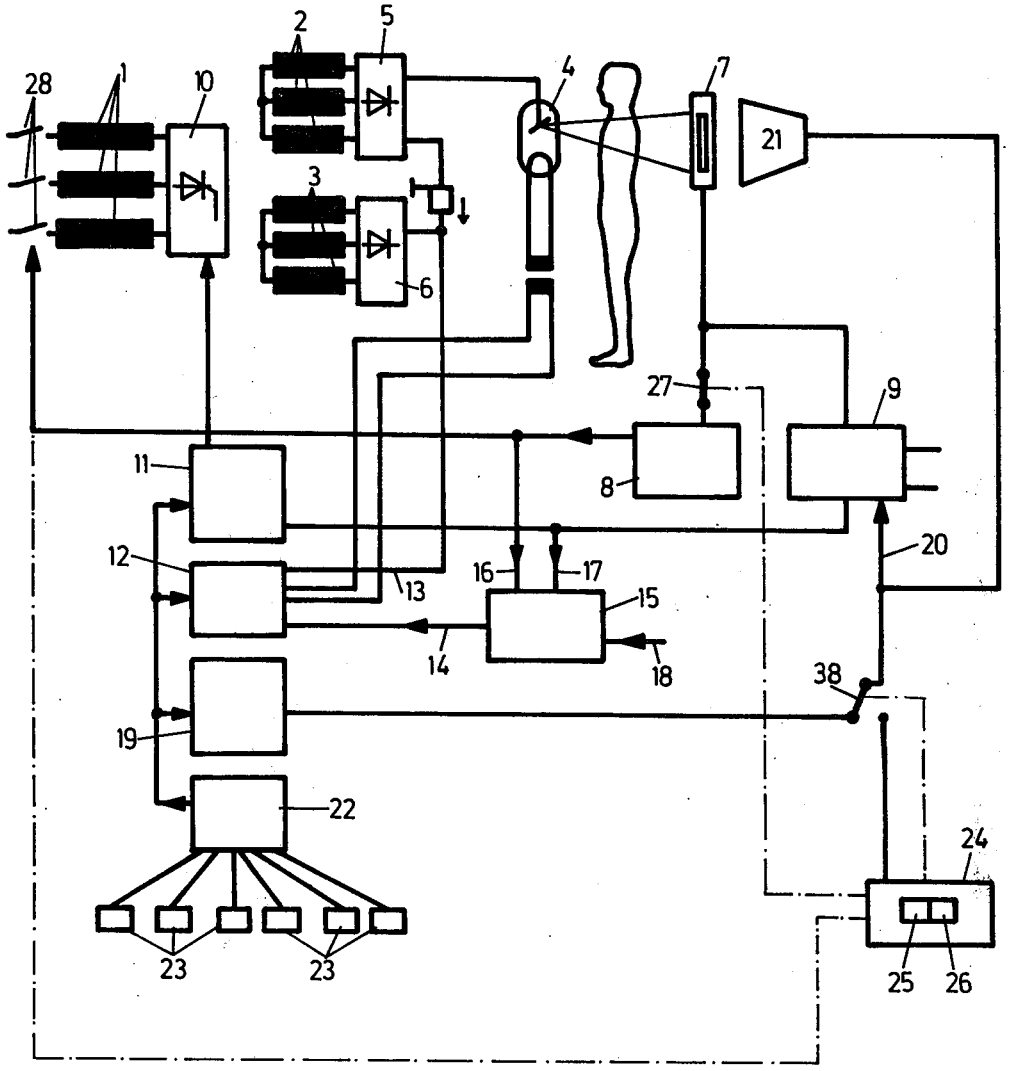
FIG. 1 schematically illustrates a circuit diagram of an X-ray diagnostic apparatus according to the present invention.

Referring now in detail to the drawings, FIG. 1 shows a three-phase high-voltage transformer which includes three primary windings 1 and two secondary winding groups 2 and 3. An X-ray tube 4 has high voltage transmitted thereto through two mutually series-connected high-voltage rectifiers 5 and 6. Rearwardly of the patient there is located an X-ray measuring chamber 7 which transmit a signal to an automatic exposure device 8 in conformance with the X-ray dosage. The same signal is also transmitted to a dose rate regulator 9 which forms therefrom a signal corresponding to the prevailing actual value of the dose rate.

Located within the primary circuit of the high-voltage transformer is an electronic switch 10, which may be opened and closed by means of a keying arrangement, conforming to the high-voltage desired at the X-ray tube 4. In order to determine the keying relationship, a kV-control element 11 is employed, which is influenced by the dose rate regulator 9. The X-ray tube current is determined by means of an mA-regulator 12, which influences the filament current of the X-ray tube 4. A signal corresponding to the actual value of the X-ray current is transmitted to the input 13 of the mA-regulator 12, and a signal transmitted to the input 14 which relates to the reference value. The reference value signal is produced by a function generator 15 which receives at its inputs 16 and 17 signals respectively corresponding to the duration of the exposure time for an exposure, and the prevailing X-ray tube voltage, and at its input 18 a signal which embodies the X-ray tube nomograph, meaning in effect, which characterizes the sequence of the X-ray tube power output during an exposure, dependent upon time.

The prevailing series program, in effect, the picture frequency, the exposure intervals, and the total number of pictures in an exposure series, are determined by a control element 19, the latter of which transmits a signal to the input 20 of the dose rate regulator 9 which characterizes the limits within which the exposure time may oscillate for an exposure. The upper limit, in that instance, is the shutter opening time of the film changer or the film camera. The film changer or the film camera is schematically illustrated in the drawing and designated by reference numeral 21. The lower limit is the shortest possible exposure time. The setting of the exposure data, namely, the data for the X-ray tube 4, as well as the data determined by the control element 19, is effected by means of a programming control installation 22 with the aid of program keys 23, which may be dependent upon the patient's organs.

Background Discussion Showing the Conventional Nature of the Program Control Installation 22, FIG. 1, and Associated Components As previously stated, the setting of the exposure data, namely the data for the X-ray tube 4 is effected by means of a programming control installation 22 with the aid of program keys 23, which may be dependent upon the patient's organs.

As stated in U.S. Pat. No. 3,546,461 under Description of the Prior Art, pulsing systems to control the precise amount of X-ray radiation per film frame in X-ray cine systems are well known. In automatic kV control systems a light sensing device either reads peak light or integrates light and controls kV in the primary of the high voltage transformer. As the use of cine X-ray has increased and medical techniques have been developed to a higher degree of precision for all parts of the body, it has been quite evident that non-synchronous cine X-ray systems are desirable because of the demand to go beyond 60 frames per second. Furthermore, variable pulse times are desirable since techniques now require extremely short times at higher milliamperes, while other techniques require longer times at lower milliamperes because of thermal limitations of the X-ray tube. In U.S. Pat. No. 3,546,461 there was provided a cine fluororadiographic apparatus comprising a phototimer which integrates time and intensity for each cine frame, a density computer which receives the output of the phototimer along with the respective outputs of a maximum and a minimum timer, the density computer comparing the three aforementioned outputs and providing a signal, when necessary, to automatically position the kV regulator to a desired setting.

As stated at column 4, line 74 of U.S. Pat. No. 3,546,461 in that system the skilled technician has already predetermined the factors to be used during cine filming. for a typical example, he has preset the cine camera to operate at 60 frames per second, has set the variable maximum limit timer to five milliseconds, and has selected a value of 200 milliamperes for tube operation. The variable minimum limit timer has been designed and adjusted to send a pulse to the density computer at a time of 60 percent that of the variable maximum limit timer which in the present case would be three milliseconds.

When the operator desires cine filming, he actuates an exposure switch which accomplishes the following:

(1) Boosts the X-ray tube filament to a 200 milliampere emission value;

(2) Automatically directs the image splitting mirror of the lens arrangement so that the output phosphor image is directed into the cine camera;

(3) Connects certain taps on the X-ray control automatic transformer to compensate for the 200 milliampere tube load;

(4) Energizes the cine camera motor within the cine camera 22;

(5) Energizes all the circuit components of the variable maximum limit timer, the variable minimum limit timer, the phototimer, and the kV regulating circuitry;

(6) Applies the bias voltage to the cathode of the X-ray tube; and (7) Closes the power to the primary of the high voltage transformer.

When the camera shutter opens, a light chopper switch triggers a positive going pulse in the bias switch circuit. This positive going pulse cancels the negative bias and allows the X-ray tube to conduct. During the initial frame in a typical examination, the X-ray intensity will be too high due to the kV being too high. The phototimer in attempting to cut the exposure time as short as possible, will produce a necessary exposure time ($T_e$) shorter than the limit ($T_{min}$) determined by the variable limit timer, that is shorter than three milliseconds. The density computer will recognize this situation and will energize the automatic kV servomotor to drive the kV down. After three or four frames the kV is lowered to where the X-ray energy is such that the phototimer terminates the exposure after three milliseconds. The density computer now recognizes that this is a satisfactory exposure and the automatic kV servomotor is turned off. As long as the phototimer is timing between three and five milliseconds, the density computer is dormant as the exposure density will be within the correct limit. On the other hand, if there is a change in the density of a body part which requires the phototimer to attempt to time longer than five milliseconds, the density computer will recognize this situation and it will energize the automatic kV servomotor to raise the kV. Therefore, as long as the phototimer is timing between three milliseconds (minimum timer $T_{min}$) and five milliseconds (maximum timer $T_{max}$) it is unnecessary to trigger the automatic kV servomotor.

It can be seen from the foregoing discussion of U.S. Pat. No. 3,546,461 that it is routine in the art for a skilled technician to set the picture frequency, the exposure intervals and the total number of pictures in an exposure series, and these routine matters form no part of the present invention. As also indicated in U.S. Pat. No. 3,546,461 the upper time limit $T_{max}$, for example the shutter opening time of the film changer of the film camera, and the lower limit such as the shortest possible exposure time $T_{min}$ are set by means of a variable maximum limit timer (such as 31 of U.S. Pat. No. 3,546,461) and by means of a variable minimum limit timer (such as 32 of U.S. Pat. No. 3,546,461).

Such setting procedure is acknowledged to be part of the teaching of U.S. Pat. No. 3,546,461, and relates to the background automatic operation of the system of FIG. 1 where the kV control element 11 is being controlled by means of a density computer (such as 30 of U.S. Pat. No. 3,546,461) which forms part of the dose regulator component 9 of FIG. 1 as has previously been discussed.

Simply for the sake of background, it has already been noted that the desired series program for cine filming including picture frequency, exposure intervals, and the total number of pictures in an exposure series are determined by control element 19 of FIG. 1, and that the setting of the data determined by the control element 19 is effected by means of a programming control installation 22, FIG. 1, with the aid of program keys 23, which ma be dependent upon the patient's organs.

To further outline the background of the present invention, reference may be made to the brochure of Siemens A.G. entitled "SIRCAM 70", English Edition, identified as MS 50/4024, and printed in West Germany in August of 1973. This brochure shows a seventy millimeter camera for single shot and serial radiography. At the fifth side of this brochure, there is described an Operating Console known as the SIRCAN 70 A. As there stated, for the operating of the SIRCAM 70 with the generators of the OPTIMATIC LINE (see Schmitmann, H.; Noske, E.; Sladek, W.; "Tridoros-Optimatic:A New Generator System" *Electromedica* 3/1971, 83), the SIRCAMATIC control has been developed. In addition to the electronic device for automatic exposure, it also makes possible organ-programmed operation with the console "SIRCAM 70 A" which can be arranged close to the equipment.

The switch off of radiography is effected by the ION-TOMAT.

The selection of frame speed is effected via organ-referred buttons, to which, in addition, the radiation hardness can be assigned in a program.

For special radiographic techniques, all the radiographic data can be set by selecting the appropriate button on the SIRCAN 70 A console, or also freely on the generator control console.

As illustrated by the seventh figure of said brochure, the Operating Console has a digital display showing the number of films transported into the take-up magazine, the number of films removed from the supply magazine, and further includes a continuous counter mechanism so that film numbering appears on the radiograph. The seventh figure of the brochure also shows organ-orientated buttons (for programmed image frequency and radiation hardness) and a further button enabling free setting at the control console of the X-ray generator.

Literature references are found at the back page of this brochure as follows: M. Pfeiler and G. Linke: "Better Indirect Radiography through High-Resolution Image Intensifiers" "Electromedica", 4/1972; Helmut Riemann; Die Bedeutung der 70-mm-Bildverstärker-Serienaufnahmen für Funktionsstudien am Magen-Darm-Trakt, Der Radiologe" Heft 9/1969; H. Gajewski und W. Schuster: Bildverstärker-photographie mit 70-mm-Kameras in der pädiatrischen Röntgendiagnostik, Deutsche Medizinische Wochenschrift, Heft 46/1968.

Discussion of Operation of Dose Rate Regulator 9, FIG. 1, and Associated Components The automatic exposure device 8 terminates each exposure of an exposure series when the ray dosage required for optimum film darkening has affected the film. As long as the exposure time switched in by the automatic exposure device 8 lies between the lower and upper limiting time, in effect, between the shortest possible exposure time and the shutter opening time, there is no change in the X-ray tube voltage. As soon as there is a drop-off below the lower limit time, the does rate regulator 9 steps into action, and by means of the kV-control element 11, effects a reduction in the X-ray tube voltage until the exposure time again lies within both of the previously mentioned limits.

If the exposure time exceeds the shutter opening time, then the dose rate regulator 9 effects an increase in the X-ray tube voltage until, similarly, the exposure time again lies within both mentioned limits. In this manner, a simple program selection is possible through key operation, at a good compromise between a low degree of movement-caused lack of definition and a good image contrast.

Description of Switch Panel 24, FIG. 1

The illustrated X-ray diagnostic apparatus includes a switch panel 24 with two keys 25 and 26, by means of which may be rigidly set the two predetermined exposure times, namely, the shortest possible exposure time and the shutter opening time. If one of the keys 25 or 26 is depressed, then switdh 27 is opened anda the automatic exposure device 8 switched off. Concurrently, through a reversed inverter switch 38, a signal is transmitted to the input 20 of the dose rate regulator 9 which characterizes the required dose rate for an optimum film darkening at the selected exposure time. The dose rate regulator 9 so varies the X-ray tube voltage whereby, within this time, there is attained an optimum film darkening. The completion of an exposure is carried out, upon depression of one of the keys 25 and 26, through a time switch located in the switching panel 24, which effects contacts 28. With a closed switch 27, the automatic exposure device 8 acts on the contacts 28 for terminating an exposure.

By means of the switch panel 24 it is possible to so influence the image character in a manner to obtain either pictures with the lowest degree of lack of definition, or pictures with an optimum image contrast. Optimum image contrast is thereby achieved when, for the shutter opening time being used as the exposure time, the X-ray tube voltage has its lowest possible value. It is possible, in effect, when the shortest possible exposure time is selected as the illuminating or exposure time by means of the keys 25 and 26, that the dosage is insufficient for an optimum film darkening since, at the highest possible X-ray tube voltage, this dosage is not reached within this time. In accordance with a further proposal of the invention, in this instance, the automatic exposure device may again be automatically switched in. The automatic exposure device 8 then terminates, at the highest possible X-ray tube voltage, the exposure upon the reaching of an optimum film darkening.

The function generator 15 has the function that, for each X-ray tube voltage which is automatically set on the basis of the X-ray tube nomograph for the highest permissible X-ray tube current at the instantaneous exposure time point, in effect, the capacity of the X-ray tube is herein alwasy optimally utilized.

Within the scope of the invention, suitable exposure times may be fixedly preprogrammed in the panel 24. It is essential that there be provided an individual ability to influence the exposure time.

Figure 2:
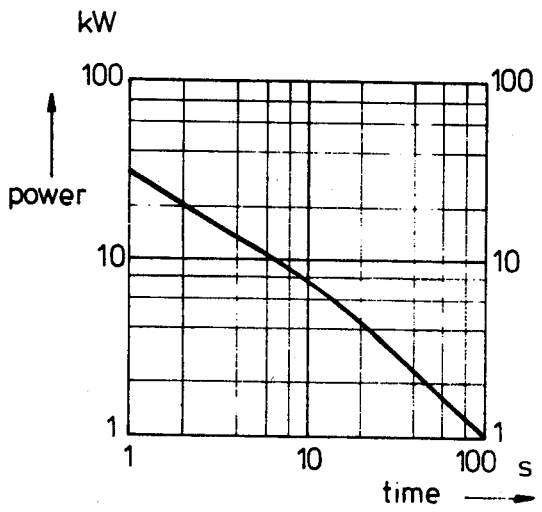
FIG. 2 graphically illustrates the power output with respect to time for the apparatus of FIG. 1.

The electronic switch 10 may be constructed in accordance with the disclosure set forth in German Laid-Open Patent Specification 1,961,621. A signal may be present at the input 18 of the function generator 15 as shown, for example, through the graph in FIG. 2. FIG. 2 shows the permissible sequence or cycle of the X-ray tube power as a function of exposure time. The function generator 15 compares the signal at its input 18, which extends pursuant to FIG. 2, with the signals at its inputs 16 and 17 and so influences the X-ray tube current, that the prevailing actual value of the X-ray tube power is equal to the reference value which is preset by the X-ray tube nomograph, according to FIG. 2. The generation of the signal pursuant to FIG. 2 at the input 18 may follow through a discharge of capacitors, which are so interconnected as to achieve the desired voltage sequence according to FIG. 2. The voltage regulator 12 may be constructed in accordance with the disclosure of U.S. Pat. No. 2,962,594.

Figure 1A:
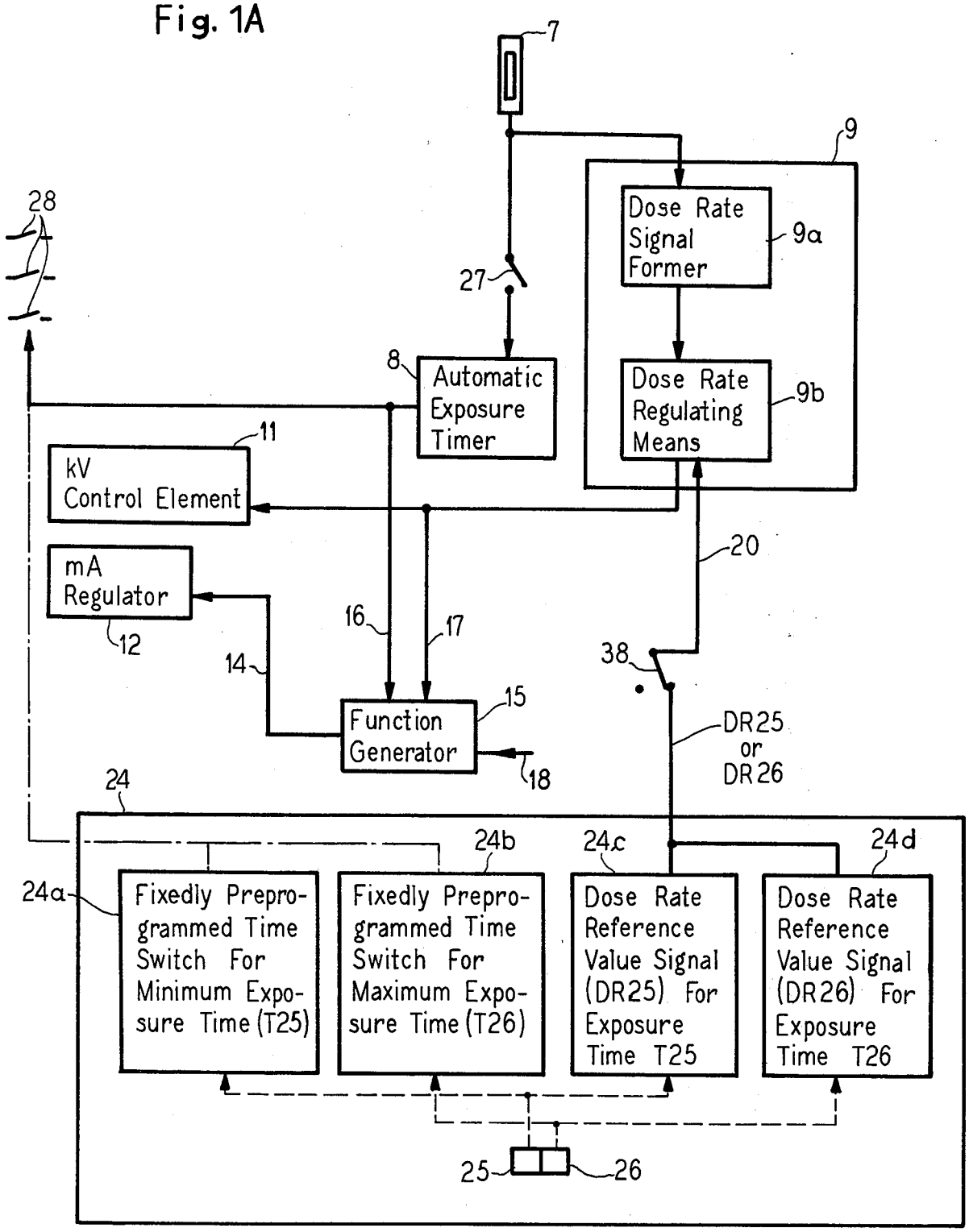
FIG. 1A shows FIG. 1 in a manual mode.

Description Of FIG. 1A

FIG. 1A shows the condition of the circuitry of FIG. 1 during manual preselection of the exposure time, the dose rate regulator 9 being shown as two separate components 9*a* and 9*b*, and switch panel 24 being shown as comprising components 24*a* through 24*d*.

As previously described herein, with reference to switch panel 24, the X-ray diagnostic apparatus includes a switch panel with two keys 25 and 26, shown at the lower right of FIG. 1A, by means of which may be rigidly set the two predetermined exposure times, namely, the shortest possible exposure time (designated T25 in FIG. 1A) and the shutter opening time (designated T26 in FIG. 1A). If one of the keys 25 or 26 is depressed, then switch 27 is opened as indicated in FIG. 1A, and the automatic exposure device 8 is switched off, this condition of device 8 being intended in FIG. 1A. Concurrently, through switch 38, when actuated to the position shown in FIG. 1A, a signal (DR 25 or DR 26) is transmitted to the input 20 of dose rate regulating means 9*b*, FIG. 1A, which signal characterizes the required dose rate for an optimum film darkening at the selected exposure time (T25 or T26). The dose rate regulating means 9*b* so varies the X-ray tube voltage whereby, within this time (T25 or T26), there is obtained an optimum film darkening. The completion of an exposure is carried out, upon depression of one of the keys 25 and 26, through a time switch located within component 24*a* or 24*b* in the switching panel 24, which controls contacts 28.

By means of the switch panel 24 it is thus possible to so influence the image character as to obtain either pictures with the lowest degree of lack of definition (using exposure time T25), or pictures with an optimum image contrast (using maximum exposure time T26). Optimum image contrast is thereby achieved when, for the shutter opening time being used as the exposure time (exposure time T26), the X-ray tube voltage has its lowest possible value. It is possible, in effect, when the shortest possible exposure time is selected as the exposure time (exposure time T25) by means of key 25, that the dosage is insufficient for an optimum film darkening since, at the highest possible X-ray tube voltage, this dosage is not reached within this time (exposure time T25). In accordance with a further proposal of the invention, in this instance, the automatic exposure device 8 may again be automatically switched in. The automatic exposure device 8 then terminates, at the highest possible X-ray tube voltage, the exposure upon reaching of an optimum film darkening.

Accordingly, as shown in FIG. 1A, manually operable switch means 24 is responsive to the actuation of key 25 or 26 to preselect an exposure time (T25 or T26) for an exposure and for switching off the automatic exposure means (timer 8). The switching means 24 actuates the dose rate regulator 9 so as to form an automatic exposure means (9*a*, 9*b*, FIG. 1A) by transmitting to the dose rate regulating means 9*b* a reference value signal (DR 25 or DR 26) for setting the desired dose rate to obtain an optimum film darkening for each particularly selected exposure time (T25 or T26). As also originally defined, the apparatus of FIG. 1A has a fixedly preprogrammed means providing a shortest possible exposure time (T25) for an exposure, said exposure time being selectable through key 25 of the manually operable switch means 24. As also originally defined, a film changer as represented by component 21 in FIG. 1 may have a given shutter opening time thereof, and component 24*b* of FIG. 1A may provide a fixedly programmed maximum exposure time T26 corresponding to the shutter opening time, such maximum exposure time T26 being selectable by actuation of key 26 of the manually operable switch means 24. As also originally defined, a film camera as represented by component 21 in FIG. 1 may have a given shutter opening time, and means 24*b* may be fixedly programmed to provide a maximum exposure time T26 corresponding to said shutter opening time, the exposure time T26 being selectable by actuation of key 26 of the manually operable switch means 24.

While there has been shown what is considered to be the preferred embodiment of the invention, it will be obvious that modifications may be made which come within the scope of the disclosure of the specification.

I claim as my invention:

1. In an X-ray diagnostic apparatus having an X-ray tube for producing series exposures, particularly moving-picture exposures, an automatic exposure timer for terminating each exposure upon attaining a predetermined ray dosage providing an optimum film darkening; and a dose rate regulator adapted to reduce the X-ray tube voltage when the exposure time set by said automatic exposure timer drops below a lower time limit and to increase the voltage when the exposure time exceeds an upper time limit, the improvement comprising; manually operable switch means for preselection of the exposure time for an exposure and for switching off said automatic exposure timer, said switching means actuating said dose rate regulator by transmitting thereto a reference value signal for the dosage rate which causes an optimum film darkening for each particularly selected exposure time, said manually operable switch means being responsive to a single manual actuation to: (a) select an exact time duration for an exposure, and (b) switch off said automatic exposure timer, and (c) transmit the reference value signal corresponding to said exact time duration.

2. An apparatus as claimed in claim 1, having a fixedly preprogrammed shortest possible exposure time for an exposure, said exposure time being selectable through said manually operable switch means.

3. An apparatus as claimed in claim 2, comprising means for switching in said automatic exposure timer upon said X-ray tube voltage set by said dose rate regulator providing a dosage inadequate to effect an optimum film darkening within the shortest possible exposure time.

4. An apparatus as claimed in claim 1, comprising a film changer having the shutter opening time thereof programmed as the exposure time, said time being selectable through said manually operable switch means.

5. An apparatus as claimed in claim 1, comprising a film camera having the shutter opening time thereof preprogrammed as the exposure time, said time being selectable through said manually operable switch means.

6. An apparatus as claimed in claim 1, comprising an mA-control element for the X-ray tube current; and a function generator transmitting a reference value signal to said mA-control element corresponding to the maximum permissible particular X-ray tube current based on the X-ray tube nomograph for the particular X-ray tube voltage and the particular transpired exposure time.

* * * * *